US006612849B1

(12) United States Patent
Scott

(10) Patent No.: US 6,612,849 B1
(45) Date of Patent: Sep. 2, 2003

(54) ROTATABLE COUPLER FOR RF/UHF CABLES

(76) Inventor: Charles Howard Scott, 251 Vaquero Dr., Martinsburg, WV (US) 25401

( * ) Notice: Subject to any disclaimer, the term of this patent is extended or adjusted under 35 U.S.C. 154(b) by 0 days.

(21) Appl. No.: 10/150,924

(22) Filed: May 21, 2002

(51) Int. Cl.[7] ..... H01R 39/00
(52) U.S. Cl. ..... 439/23; 439/28
(58) Field of Search ..... 439/13, 21, 23, 439/27, 28, 30, 578, 668, 22, 29

(56) References Cited

U.S. PATENT DOCUMENTS

| | | | | |
|---|---|---|---|---|
| 1,404,097 A | | 1/1922 | Dennis | 439/30 |
| 1,665,018 A | | 4/1928 | Black | 439/668 |
| 2,542,935 A | | 2/1951 | McElroy | 439/127 |
| 2,923,907 A | | 2/1960 | Buckelew | 439/128 |
| 3,437,976 A | | 4/1969 | Nelson | 439/23 |
| 3,536,870 A | | 10/1970 | Izumi | 200/51.1 |
| 3,671,922 A | * | 6/1972 | Zerlin et al. | 439/352 |
| 3,847,463 A | | 11/1974 | Hayward et al. | 439/28 |
| 4,022,518 A | | 5/1977 | Gattaz | 439/28 |
| 4,336,974 A | | 6/1982 | Wilson | 439/13 |
| 4,488,139 A | | 12/1984 | Snider, Jr. | 439/23 |
| 4,894,014 A | | 1/1990 | Palus et al. | 439/17 |
| 4,988,963 A | | 1/1991 | Shirosaka et al. | 333/261 |
| 5,376,022 A | * | 12/1994 | Carr et al. | 439/668 |
| 5,419,707 A | | 5/1995 | Kelley | 439/21 |
| 5,454,735 A | * | 10/1995 | Nelson | 439/578 |
| 5,498,175 A | | 3/1996 | Yeh et al. | 439/578 |

* cited by examiner

*Primary Examiner*—Tulsidas C Patel
(74) *Attorney, Agent, or Firm*—Lawrence R. Franklin

(57) ABSTRACT

A coupler for electrically connecting two coaxial cables together is disclosed. The coupler includes a body and a turret which are rotatable relative to each other. One cable is attached to the body and another is attached to the turret, so they are also relatively rotatable. Electrical connectors are provided on the coupler to mate with the connectors on the cables. A variety of connector sizes and types are possible.

20 Claims, 3 Drawing Sheets

ROTATABLE COUPLER FOR RF/UHF CABLES

BACKGROUND OF THE INVENTION

1. Field of the Invention

This invention relates to a rotatable coupler for electrically connecting two RF or UHF coaxial cables together. The coupler allows for relative rotation between the cables, thereby preventing damaging torques from occurring during use.

2. Description of Related Art

There are many environments in which a coaxial cable used to transmit RF or UHF signals is subject to intermittent or continual rotational forces as a part of its normal duties. For instance, a long coaxial cable is normally coiled during storage and transport. When connecting such a coaxial cable to an antenna or to another coaxial cable in a coaxial line, each coaxial cable is uncoiled. As each is uncoiled to add it to the line, straightening the cable produces rotational torques within it and applies them to all of the cables connected to it. Between their ends, coaxial cables are designed to withstand these forces, but they are vulnerable at their ends where they connect to each other or to intermediate connectors. Without some way of eliminating the rotational forces or of relieving their effects, at least one of the cables along the line will inevitably fail, requiring the line to be inspected to determine which cable has failed and requiring the subsequent replacement thereof. When in the field, such a failure is never convenient and is always expensive.

A prior art cable connector 10 typical of those currently used in the field is shown in FIG. 3 in a perspective view, partly in section. Connector 10 releasably joins a first cable 12 and a second cable 14.

Both cables 12 and 14 are coaxial cables such as are commonly used to transmit RF or UHF signals. The structural configurations of both cables 12 and 14 are in most respects the same, so common reference numerals are used to denote corresponding elements. Cables 12 and 14 comprise a central lead 16 and a conductive outer sleeve 18 (see the portion of cable 14 which is in section), the conductors 16 and 18 being separated and supported by an insulative material 20 (cable 12). A tough but flexible skin 22, reinforced by a helical wire 24 imbedded therein (cable 14), protects the innards of cables 12 and 14 from physical damage during transport, storage, and use. Conductive ferrules 26 are fixed to the ends of cables 12 and 14 to effect signal transfer from one cable to another.

Connector 10 comprises a cylindrical, metallic extension 28 integral with ferrule 26 of cable 12 and an elongated, metallic, cylindrical ring 30 rotatably attached to ferrule 26 of cable 14. Extension 28 has an externally threaded end 32 which mates with internal threads 34 in cylindrical ring 30, much like the two connecting ends of an ordinary water hose. When extension 28 and cylindrical ring 30 are threadedly connected, a knife-like tip 36 of central lead 16 of cable 14 is forced into and gripped by resilient fingers 38 of central lead 16 of cable 12, thus assuring good conductivity along the central leads. Conductivity through outer sleeves 18 is through extension 28, cylindrical ring 30, and ferrules 26. Each of ferrules 26 have a flange 40 in conductive contact with sleeve 18, as shown in the broken-away portion of cable 14.

When ring 30 is securely joined together with extension 28 via threads 32 and 34, cables 12 and 14 cannot rotate or swivel relative to each other. Any torques on either cable are resisted by the internal structures of the cables. When a failure occurs, it most usually occurs in the area of the juncture of flange 40 and sleeve 18.

Other inventors have addressed problems arising when connecting coaxial cables. Representative are the U.S. Pat. Nos. 3,847,463 to Hayward et al., 4,022,518 to Gattaz, 4,336,974 to Wilson, 4,988,963 to Shirosaka et al., and 5,419,707 to Kelley. While undoubtedly effective for their purposes, to the inventor's knowledge, they and others like them tend to be complicated, expensive, and have not met with widespread acceptance.

OBJECTS AND SUMMARY OF THE INVENTION

The present invention overcomes the difficulties described above by providing a coupler for a pair of coaxial cables, said coupler permitting good transmission of RF and/or UHF signals while concurrently permitting relative rotation between the cables coupled thereby. As a consequence, both cables are relieved of the stresses normally imposed by the rotational torques suffered by moving the cables, which greatly extends their useful lives.

It is an object of the invention to provide a coupler for coaxial cables which permits relative rotation or swivelling between the cables.

It is a further object of the invention to provide a coupler for coaxial cables which resists linear forces along the line while permitting relative rotation.

It is a further object of the invention to provide a coupler for coaxial cables in which the burden for the rotational and non-linear constraints are carried by the coupler housing structure and not by the electrical components thereof.

It is a further object of the invention to provide a coupler for coaxial cables which effectively transmits the signals therein from one cable to another while permitting easy rotation therebetween.

It is a further object of the invention to provide a coupler for coaxial cables which shields the signals in the coupler as they are transmitted from one coaxial cable to another.

It is a further object of the invention to provide a coupler for coaxial cables which is easy to attach and detach from the cables.

It is a further object of the invention to provide a coupler for coaxial cables which permits adapting the coupler for different input and output connectors on the ends of coaxial cables.

It is a further object of the invention to provide a coupler for coaxial cables which is simple in structure and inexpensive to manufacture.

It is a further object of the invention to provide a coupler for coaxial cables which is small enough that an extensive inventory of couplers and parts can easily be carried into the field.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
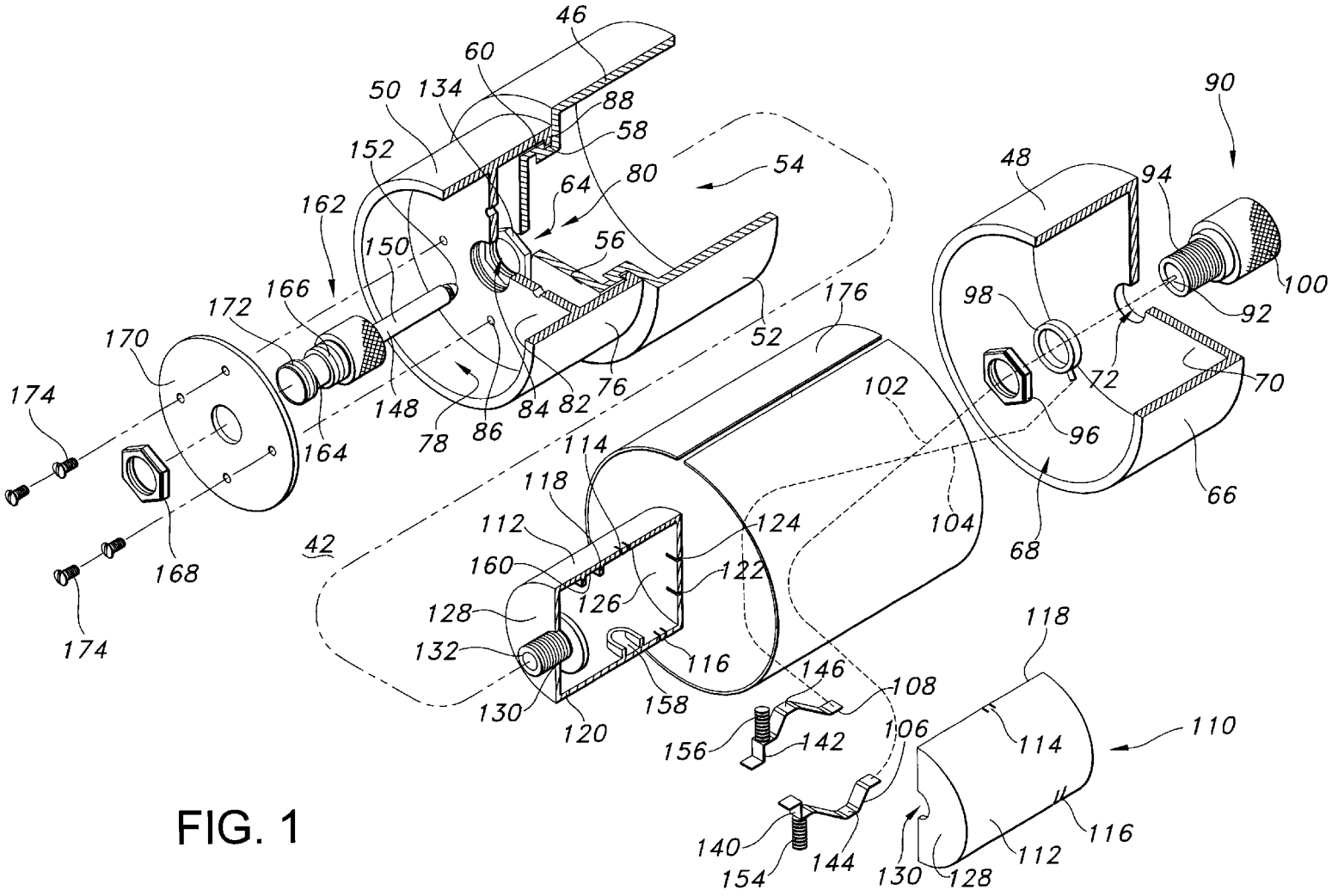
FIG. 1 is an exploded perspective view, partially in cross-section, which illustrates the preferred embodiment of the present invention.
Figure 2:
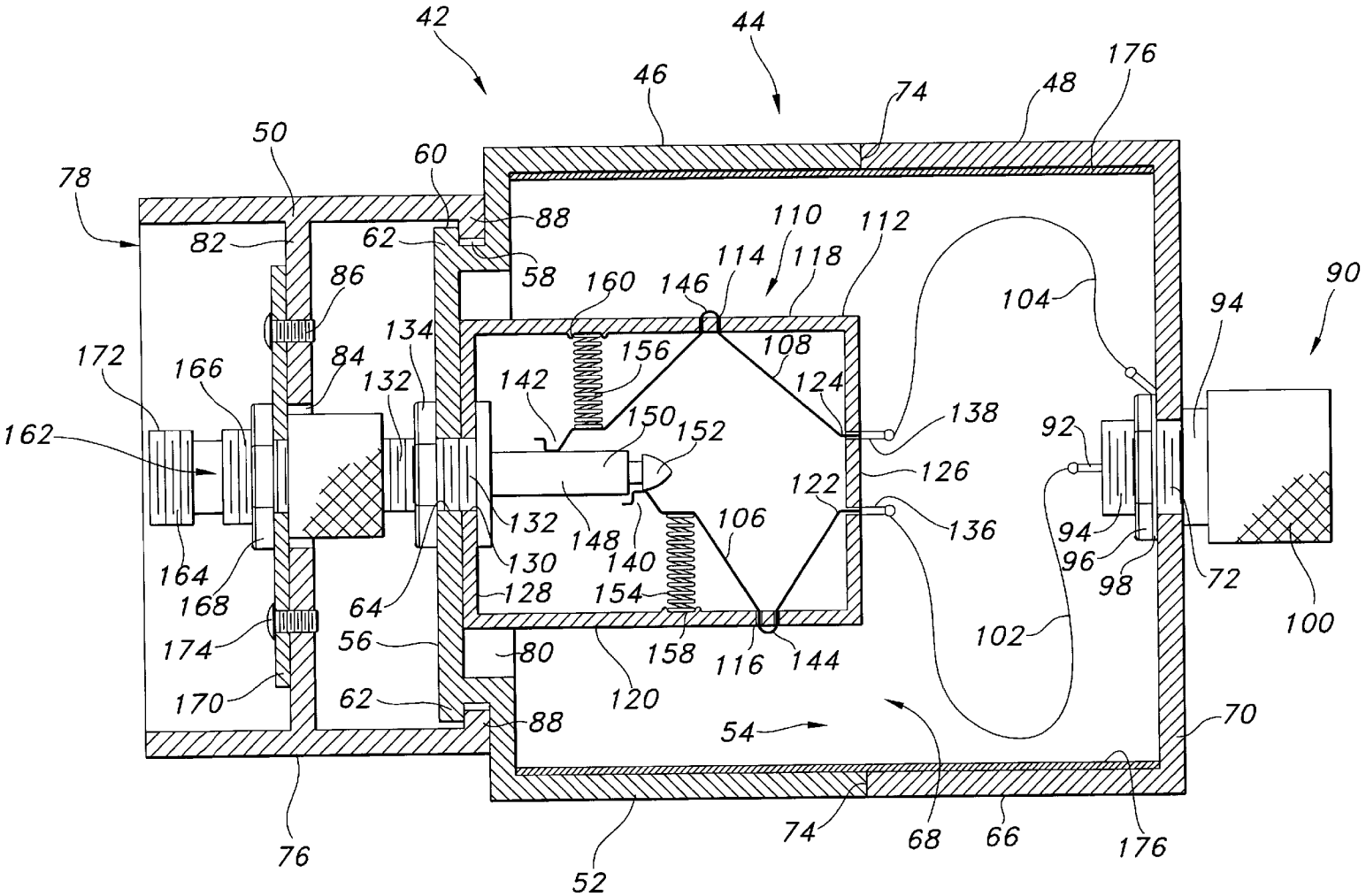
FIG. 2 is a cross-sectional view of the invention of FIG. 1 as assembled.

Turning to FIGS. 1 and 2, coupler 42 is shown in FIG. 1 in an exploded perspective view, partially in section, to show certain internal features more clearly, and in FIG. 2 in a cross-sectional view as assembled.

Coupler 42 is externally visible as a closed housing 44 (FIG. 2), said housing 44 comprising a body 46 and a cap 48. Housing 44 is rotatably connected to a turret 50. In use, one cable (not shown) is fixedly attached to housing 44 and another cable (not shown) is fixedly attached to turret 50. Unrestricted relative rotation of housing 44 and turret 50 permits unrestricted relative rotation of the two cables. While the disclosure herein is in terms of coupling two coaxial cables together, this is for descriptive purposes only. It is considered to be within the scope of the invention that coupler 42 attach two disparate types of signal-carrying devices together, such as a cable to a stationary device. For example, in a CATV system, the coaxial cables must be periodically attached to an amplifier in order to boost the signal strengths which have degenerated due to their travel through extended lengths of the cables. The amplifiers are fixed, whereas the cables experience relative rotational and vibrational stresses caused by environmental forces, such as gusting winds. Coupler 42 protects both cables and amplifiers from potentially damaging twisting motions.

Body 46 comprises a cylinder 52, open at one end 54, and partially closed by an integral, transverse wall 56 at the other end. Transverse wall 56 is spaced from cylinder 52 by an annular recess 58. Two embodiments of recess 58 are shown. In FIG. 1, a cylindrical bearing surface 60 supports turret 50 for smooth rotation; the axial length of said bearing surface 60 is not critical and can be as long or as short as desired. In FIG. 2, bearing surface 60 is shown as shortened to an outwardly extending peripheral flange 62, essentially a radial extension of transverse wall 56.

A centrally located aperture 64 passes through transverse wall 56.

Cap 48 likewise comprises a cylinder 66, open at one end 68, and partially closed by a transverse wall 70 at the other. A centrally located aperture 72 pierces wall 70. The diameters of cylinders 52 and 66 are preferably the same, so that when joined together at 74 (FIG. 2), they present a smooth, unbroken outer exterior. Prior to assembly, open ends 54 and 68 provide easy access to both sides of transverse walls 56 and 70, respectively, to facilitate attaching other components, as will be described shortly.

Once the other components are in place, body 46 and cap 48 are fixedly joined together by welding, by an adhesive, or by any other suitable means, for closing housing 44. It is preferred that housing 44 be fixedly sealed as shown.

Turret 50 also comprises a cylinder 76, open at both ends 78 and 80 with an intermediate transverse wall 82 closing the passage through turret 50 except for a centrally positioned aperture 84 through wall 82. A plurality of holes 86 are uniformly spaced around aperture 84 for a purpose to be described shortly. Integral with end 80 is an inwardly projecting, annular flange 88 which fits snugly but non-bindingly within recess 58 of body 46, permitting smooth relative rotation between turret 50 and housing 44 while constraining against axial movements therebetween.

Body 46, cap 48, and turret 50 are preferably molded of ABS, for it is strong, crack-resistant, and does not nick or chip. ABS is also externally smooth and comfortable to handle. Any other material, however, which is rugged enough to withstand the rigors of being exposed to the rough handling and the rough terrain of the normal habitat of coaxial lines will do.

Returning to FIGS. 1 and 2, the electrical components will now be described.

Attached to cap 48 is an electrical connector 90. Connector 90 comprises any known coaxial connector, plug or jack, which would be needed to mate with a complementary connector on the cable intended for use therewith.

Figure 3:
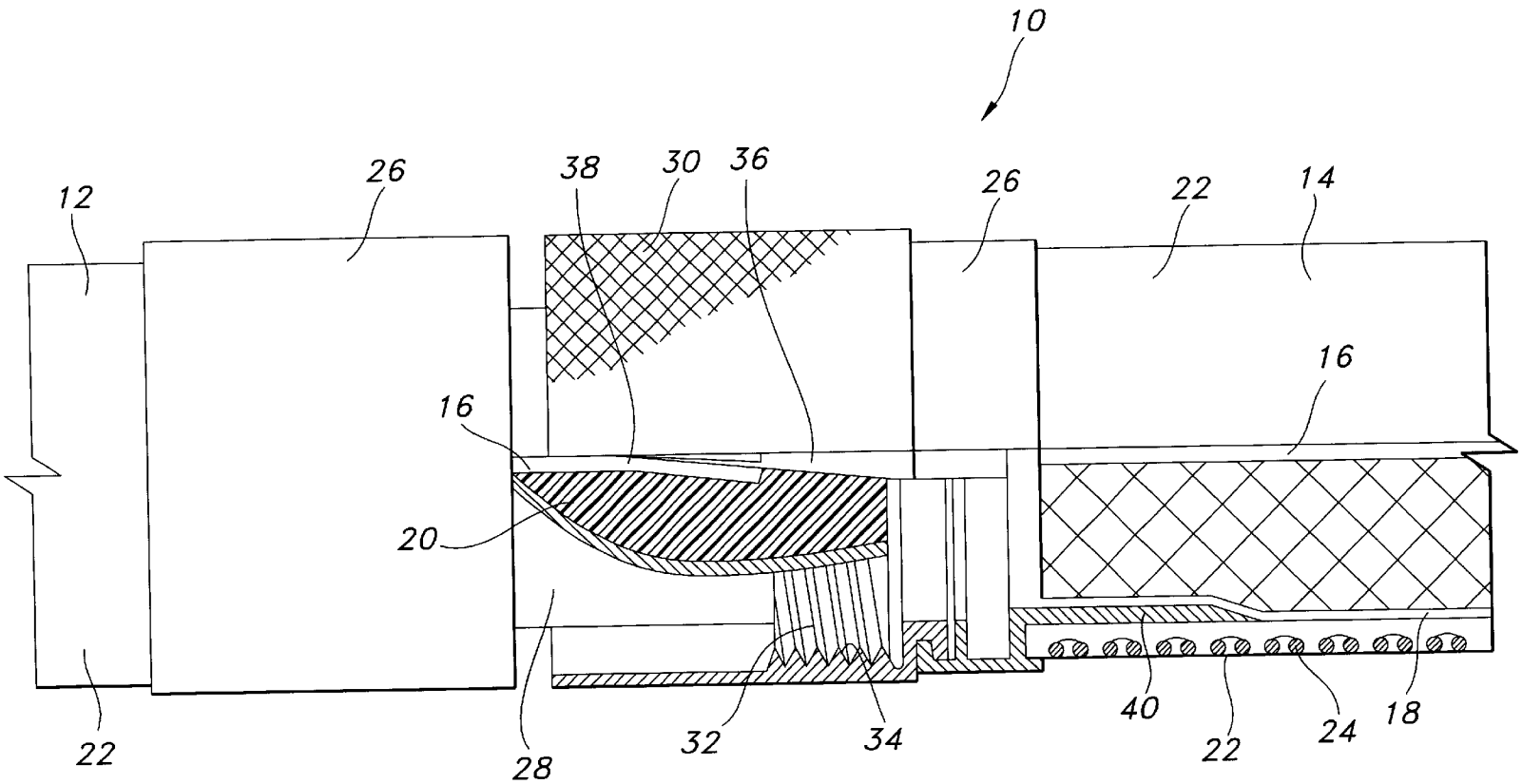
FIG. 3 (PRIOR ART)
FIG. 3 is a perspective view, partially in cross-section, of a prior art cable connector.

Coaxial cables are typically provided with electrical connectors on their two ends. Some cables have a plug on one end and a jack on the other, so that they can be attached together in seriatum, such as is shown in FIG. 3. Other cables are assembled with plugs on both ends, like ordinary TV cables found in the home for connecting a TV to a wall jack, or with jacks on both ends. The connectors are also provided in different sizes to accomodate different sized cables designed for different usages. Coupler 42 is readily adaptable for all contingencies.

It is contemplated that a variety of couplers 42 will be manufactured, each with the plugs and/or jacks which fulfills the needs of its intended environment. Consequently, the description herein is generic as to the nature of the connectors provided on coupler 42. The specific connectors shown are for illustrative purposes only and are not restrictive of the scope of the invention.

Connector 90 is shown as a plug, similar to that connected to cable 14 in FIG. 3. Connector 90 comprises an electrically active central lead 92 surrounded by a cylindrical, conductive sleeve 94. A suitable insulation material (not shown) separates and supports lead 92 and sleeve 94. Sleeve 94 is externally threaded to permit fastening of connector 90 to transverse wall 70 by means of a nut 96 and washer 98. In the preferred embodiment, connector 90 is permanently, non-rotatably attached to cap 48. As such, the manner of attaching it to transverse wall 70 can alternatively be varied to include welding, bonding by adhesives, or by any other more permanent method. Attachment by means of a nut and washer is but an example of one method of assembling connector 90 to cap 48. An elongated, metallic, cylindrical ring 100, similar to ring 30 in FIG. 3, is rotatably attached to sleeve 94. Ring 100 releasably connects coupler 42 to a complementary jack on a first coaxial cable, such as cable 12. When so connected, said first coaxial cable is non-rotatable relative to housing 44.

Wires 102 and 104 are electrically connected to central lead 92 and to washer 98, respectively. Wire 102 electrically connects lead 92 and a terminal 106; wire 104 electrically connects a terminal 108 to washer 98 and therethrough to sleeve 94. Terminals 106 and 108 are positioned within a jack housing 110 in the manner best shown in FIG. 2.

Jack housing 110 is preferably constructed from mating clam-shell halves 112, seen more clearly in FIG. 1, which are initially separated to allow insertion of the components held therewithin but which form a closed, protective cylinder when assembled. Pairs of slots 114 and 116 are formed in opposing longitudinal edges 118 and 120 of clam-shell halves 112, and two slots 122 and 124 are formed in the facing edges of both halves of the closed end wall 126 of jack housing 110. Prior to the joining of clam-shell halves 112, slots 114–116 open at one end through edges 118 and 120 and slots 122–124 open at one end through both halves of closed end wall 126, respectively, to provide easy access for laying terminals 106 and 108 therewithin. Slots 114–116 and 122–124 are shown (FIG. 1) formed in both halves 112, but it is clear that they may be present in only one half, so long as they are open at one end for receiving terminals 106 and 108. An end wall 128 closes the opposite end of jack housing 110, except for an aperture 130 therethrough. An externally threaded, hollow-stemmed bolt 132 is inserted through aperture 130 of jack housing end wall 128 and through aperture 64 of transverse wall 56 of body 46. A nut 134 threads onto bolt 132 to attach jack housing 110 to wall 56, and thereby to housing 44; see FIG. 2.

Referring to FIG. 2, when jack housing 110 is fully assembled, the major portions of the lengths of terminals 106 and 108 are confined within jack housing 110. Terminals 106 and 108 have ends 136 and 138 protruding through slots 122 and 124, respectively. Wires 102 and 104 are electrically connected with protruding ends 136 and 138. The opposite ends 140 and 142 of terminals 106 and 108 are free, being essentially cantilevered from bights 144 and 146 which are intermediate confined ends 136 and 138 and free ends 140 and 142. Bights 144 and 146 are interleaved through the pairs of slots 114 and 116 to fix them in jack housing 110 and to provide a fulcrum for pivotally supporting free ends 140 and 142. All slots through jack housing 110 are preferably sealed by a potting material (not shown), after terminals 106 and 108 have been placed therein, to protect its interior. Jack housings 110 are manufactured separately and attached to housing 44 when the latter is assembled for a specific connector pair.

Free ends 140 and 142 have reverse bends which present smooth surfaces for making swiping electrical contact with a common pin-type plug 148. Plug 148 comprises a shaft 150 which forms one electrical contact of plug 148 and a tip 152 which forms the other electrical contact. Shaft 150 is electrically isolated from tip 152, as is well known. Springs 154 and 156 bias free ends 140 and 142 into secure frictional contact with tip 152 and shaft 150, respectively. The interior wall of clam-shell halves 112 are provided with seats 158 and 160 for constraining one end of springs 154 and 156 against movement. Springs 154 and 156 may be adhesively fixed within seats 158 and 160, if desired.

Referring primarily to FIG. 1, pin-type plug 148 can be seen to be one end of a connector 162. A jack 164 is provided at its opposite end. Jack 164 includes a first externally threaded portion 166 which mates with a nut 168 to attach connector 162 to an intermediary connecting member, shown as a disk 170. Inasmuch as jack 164 is intended to be fixed to disk 170, the two can be permanently joined together by any other convenient means. Jack 164 further includes a second threaded portion 172, similar to threaded portion 32 of extension 28 of cable 12, which is adapted for connecting with a second coaxial cable, similar to cable 14 in FIG. 3. The second coaxial cable (not shown) is assumed to include an internally threaded connector, such as ring 30, for attachment to threaded portion 172 of connector 162.

Disk 170 is attached to intermediate transverse wall 82 of turret 50 by a plurality of screws 174 threaded into apertures 86. Preferably, screws 174 are machine screws and apertures 86 are pre-threaded.

The primary purpose of permanently attaching connector 162 to disk 170 which in turn is removably attached by screws 174 to intermediate transverse wall 82 of turret 50 is to facilitate assembly of connector 162 to turret 50. Turret 50 is rotatably coupled to body 46 during the forming of the two components. Aperture 84 is enlarged in diameter such that sufficient access is provided to nut 134 so that jack housing 110 can be affixed to wall 56. But, mounting connector 162 directly to turret wall 82, such that axial movement therebetween is prevented, is difficult due to the inaccessibility of the interior of turret 50 between wall 82 and flange 88. Mounting connector 162 to disk 170 first and then mounting disk 170 to turret wall 82 is an easy way to accomplish the task.

A fringe benefit is provided thereby, however: Different types or sizes of coaxial cables can be inserted into an existing coaxial cable line by using coupler 42 as an adapter.

Coaxial cables are available in many different standard sizes and types, each with its own standard connectors. In order for coupler 42 to be able to accomodate them, it is contemplated that jack 164 be produced in complementary standard sizes and types to mate with those standard connectors. Pin-type plug 148, however, must be the same for all connectors 162, for it is necessary for shaft 150 and tip 152 be of a uniform physical size to make effective electrical contact with the free ends 140 and 142 of contact terminals 104 and 106 within jack housing 110. Manufacturing connectors 162 in a variety of embodiments, differing only in the sizes and types of jacks 164, permits one size or type of connector 162 to be replaced by a different size or type of connector 162, a feature which permits coupler 42 to have one connector, e.g., connector 90, of one size or type and the other, e.g., connector 162, to be of another size and type. Thus, because of the design of the combination of connector 162 and disk 170, different types and sizes of coaxial cables can be inserted into an existing coaxial cable line. This could be of great benefit should an emergency arise where a cable line must be completed now, or a coaxial cable must be replaced in an existing line in the field, but another cable of the type being used is not available, a different type of coaxial cable can be inserted, thanks to coupler 42.

This feature also allows cables to be removably attached to coupler 42 without having to remove connector 162 from its cable.

Returning to coupler 42 and completing the description of the components therein, a metallic foil 176 is provided within housing 44. Foil 176 acts as an electromagnetic shield protecting the internal components, especially the exposed contacts of terminals 106 and 108 and pin-type plug 148, from outside electromagnetic signals which might interfere with the reliable transmission of RF or UHF signals through coupler 42. Foil 176 preferaby comprises an essentially cylindrical, longitudinally-split sleeve sheet which is spring-biased outwardly. After foil 176 has been compressed and inserted within the interior of housing 44, it will spring outwardly to fit against the inner wall of cylinders 52 and 66, where it will surround the portions of connector 90, wires 102 and 104, and jack housing 110 which are housed therein. As an alternative to foil 176, a metallic layer may be deposited on the interior surfaces of housing 44 as part of their manufacture.

The manner of using coupler 42 will now be described.

It is assumed coupler 42 has been previously assembled. That is, the appropriate connector 90 has been selected and attached to cap 48. Jack housing 110 has also been previously assembled and attached to body 46. Foil 176 has been inserted within the interior of housing 44. Wires 102 and 104 are electrically connected between connector 90 and terminals 106 and 108. And, body 46 and cap 48 have been joined together to form housing 44. Turret 50 and body 46 had already been rotatably attached during the manufacture thereof. The appropriate connector 162 has been selected and mounted on disk 170. Plug 148 has been inserted through the hollow interior of bolt 132, which guides and stabilizes plug 148, tip 152 cams free ends 140 and 142 against the bias of springs 154 and 156 until shaft 150 is in electrical contact with terminal 108 and tip 152 is in electrical contact with terminal 106. And, disk 170 has been attached to transverse wall 82 of turret 50. Coupler 42 is now ready for use in the field.

In use, a first coaxial cable is attached to connector 90, and since connector 90 is fixed to housing 44, first coaxial cable and housing 44 rotate together. A second coaxial cable is connected to jack 164. Being fixed together, connector 162, said second coaxial cable, and turret 50 rotate together. Inasmuch as turret 50 freely rotates relative to housing 44, the first and second coaxial cables are likewise free to rotate relative to each other, thereby relieving any potentially damaging torques produced thereby. Electrical contact between said first and second cables is maintained throughout all relative rotations therebetween by swiping contact of free ends 140 and 142 on tip 152 and shaft 150.

Longitudinal strains are resisted by virtue of connector 90 being bolted to cap 48, connector 162 being threadedly fastened to turret 50, and turret 50 being rotatably joined to body 46 by annular flange 88 nesting within annular recess 58.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims.

I claim as my invention:

1. A coupler for rotatably connecting together a pair of signal-carrying devices, each of said signal-carrying devices having at least one electrical connector fixed thereto, said coupler comprising:

a coupler housing;

a coupler turret;

said coupler turret and said coupler housing being joined together such that they are rotatable while being constrained against axial movement;

a first electrical connector, said first electrical connector having first and second ends, said first end of said first electrical connector being adapted to be connected to said at least one electrical connector on a first of said signal-carrying devices, and said second end of said first electrical connector being fixedly attached to said coupler housing;

a second electrical connector, said second electrical connector having first and second ends, said first end of said second electrical connector being adapted to be connected to said at least one electrical connector on the other of said signal-carrying devices, and said second end of said second electrical connector being fixedly attached to said coupler turret;

each of said first and second electrical connectors including a pair of electrical conductors for making electrical contact with the conductors of said signal-carrying devices; and a jack located within said coupler housing, said jack including a pair of terminals, said pair of terminals being fixedly electrically connected to said pair of electrical conductors of said first electrical connector and rotatably electrically connected to said pair of electrical conductors of said second electrical connector.

2. The coupler of claim 1 wherein at least one of said signal-carrying devices is a coaxial cable.

3. The coupler of claim 2 wherein both of said signal-carrying devices are coaxial cables.

4. The coupler of claim 1 wherein said pair of electrical conductors of said second electrical connector comprise a pin-type plug, said pin-type plug comprising a shaft which forms one electrical contact of plug and a tip which forms the other electrical contact, said shaft being electrically isolated from said tip.

5. The coupler of claim 4 wherein one of said pair of terminals of said jack comprises a free end in swiping electrical contact with said shaft and the other of said pair of terminals of said jack comprises a free end in swiping electrical contact with said tip.

6. The coupler of claim 5 wherein said free ends are individually spring biased into swiping contact with said shaft and said tip, respectively.

7. The coupler of claim 6 wherein said spring bias is effected by a spring pressing against its associated said free end.

8. The coupler of claim 1 wherein said pair of electrical conductors of said first electrical connector comprises an electrically active central lead coaxially surrounded by a cylindrical, conductive sleeve, said lead and said sleeve being separated and supported by an electrically insulative material.

9. The coupler of claim 1 wherein said jack comprises a jack housing, said jack housing comprising a cylinder, closed at one end and closed at the other except for an aperture therethrough, and an externally threaded, hollow-stemmed bolt inserted through said aperture, and said jack housing being fixed to said coupler housing by nut threaded onto said hollow-stemmed bolt.

10. The coupler of claim 9 wherein said jack housing substantially encloses said pair of terminals, one end of each of said terminals being fixed to a wall of said jack housing and protruding therethrough, said one end of each said terminals being fixedly electrically connected to one of said pair of electrical conductors of said first electrical connector, the other end of each of said terminals being free and cantilevered from a bight intermediate said one end and said free end, each said bight being interleaved through a pairs of slots in the walls of said jack housing.

11. The coupler of claim 1 further comprising a nut and an intermediary connecting member, wherein said second end of said second electrical connector comprises a first externally threaded portion, said nut mating with said first externally threaded portion to connect said second electrical connector to said intermediary connecting member, said intermediary connecting member then being fixedly attached to said turret.

12. The coupler of claim 11 wherein said second end of said second electrical connector comprises a second threaded portion for removably fastening said second electrical connector to said at least one electrical connector on the other of said signal-carrying devices.

13. The coupler of claim 1 further comprising an electromagnetic shield located within said coupler housing for protecting said pair of terminals and said pair of electrical conductors of said second electrical connector from outside electromagnetic signals.

14. The coupler of claim 13 wherein said shield comprises a metallic foil sheet inserted between the inner wall of said coupler housing and said pair of terminals and said pair of electrical conductors of said second electrical connector.

15. The coupler of claim 13 wherein said shield comprises a metallic layer deposited on the interior surface of said coupler housing.

16. A coupler for rotatably connecting together a pair of coaxial cables, said coupler comprising:

a housing and a turret, said turret and said housing being joined together such that they are rotatable while being constrained against axial movement;

a first electrical connector, said first electrical connector being adapted at one end to be connected to one of said pair of coaxial cables, and the other end of said first electrical connector being fixedly attached to said housing;

a second electrical connector, said second electrical connector being adapted at one end to be connected to the other of said pair of coaxial cables, and the other end of said second electrical connector being fixedly attached to said turret;

each of said first and second electrical connectors including a pair of electrical conductors for making electrical contact with the conductors of said coaxial cables; and a jack located within said housing, said jack including a pair of terminals, said pair of terminals being fixedly electrically connected to said pair of electrical conductors of said first electrical connector and rotatably electrically connected to said pair of electrical conductors of said second electrical connector.

17. The coupler of claim 16 wherein said other end of said second electrical connector is attached to an intermediary connecting member, said intermediary connecting member being attached to said turret.

18. The coupler of claim 17 wherein said pair of electrical conductors of said second electrical connector comprise a pin-type plug, said pin-type plug comprising a shaft which forms one electrical contact and a tip which forms the other electrical contact, said shaft being electrically isolated from said tip.

19. The coupler of claim 18 wherein one of said pair of terminals of said jack comprises a free end in swiping electrical contact with said shaft and the other of said pair of terminals of said jack comprises a free end in swiping electrical contact with said tip.

20. The coupler of claim 16 wherein said first and second electrical connectors and said electrical connectors of said coaxial cables comprise complementary RF or UHF connectors.

* * * * *